US006506977B2

(12) United States Patent
Zhang et al.

(10) Patent No.: US 6,506,977 B2
(45) Date of Patent: Jan. 14, 2003

(54) METHOD OF WIRE INTEGRATION FOR A ROUND CABLE

(75) Inventors: Jun Wu Zhang, Kunsan (CN); Ping Kun Wang, Kunsan (CN); Guo Liang Yang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/881,266

(22) Filed: Jun. 13, 2001

(65) Prior Publication Data

US 2002/0084093 A1 Jul. 4, 2002

(30) Foreign Application Priority Data

Dec. 30, 2000 (TW) ..... 89128440 A

(51) Int. Cl.[7] ..... H01B 7/08
(52) U.S. Cl. ..... 174/117 F; 439/456
(58) Field of Search ..... 174/117 F, 72 A, 174/117 A, 117 R; 439/456, 404, 405, 466, 468

(56) References Cited

U.S. PATENT DOCUMENTS 3,082,292 A * 3/1963 Gore ..... 174/117 F
4,767,891 A * 8/1988 Biegon et al. ..... 174/112
5,359,150 A * 10/1994 Ikeuchi ..... 174/117 A
5,499,928 A * 3/1996 Satoh ..... 174/117 F
6,123,570 A * 9/2000 Hwang ..... 439/456
6,326,549 B1 * 12/2001 Kunii et al. ..... 174/117 F

FOREIGN PATENT DOCUMENTS

GB 2084811 A * 4/1982 ..... H01B/7/00

* cited by examiner

*Primary Examiner*—Chau N. Nguyen
(74) *Attorney, Agent, or Firm*—Wei Te Chung

(57) ABSTRACT

A method of integrating a plurality of wires (40) of an electrical round cable (4) provides a jig (1) including an upper block (3) and a lower block (2). The lower block has a jig plane (20) in which a plurality of receiving grooves (22) is defined. The wires of the round cable are placed into the receiving grooves of the lower block. An adhesive strip (5) is placed onto insulative sheaths of the wires. The upper block is moved downwardly to depress the adhesive strip against the insulative sheaths. Simultaneously, the adhesive strip is heated so that it partly melts and integrally joins with the insulative sheaths.

1 Claim, 9 Drawing Sheets

METHOD OF WIRE INTEGRATION FOR A ROUND CABLE

BACKGROUND OF THE INVENTION

1. Field of the Invention

The present invention relates to integration of wires of an electrical cable, and particularly to a method for accurately integrating multiple wires in a high-density round cable in preparation for attachment of a connector thereto.

2. Description of the Prior Art

An electrical round cable is commonly used to transmit signals between two electrical devices. A cable end connector which is attached to an end of the round cable is mated with a complementary connector in a corresponding electrical device. To attach the wires of the round cable to the cable end connector is generally laborious and troublesome work. Thus, better ways to attach a cable to a connector have been sought.

An integrating method for more effectively attaching a cable to a connector is shown in FIG. 9, which is taken from U.S. Pat. No. 6,189,769. A jig is used to arrange wires 90 of a round cable 9. The jig includes a first block 80 and a second block 82. A plurality of receiving grooves 800, 820 is defined in jig planes of the first and second blocks 80, 82. The receiving grooves 800, 820 cooperate to define a plurality of circular hdes each of which has a diameter slightly larger than a diameter of the wires. In use, an adhesive strip 7 is firstly placed on the first block 80. The wires 90 are placed in the receiving grooves 800 in a predetermined order. Another adhesive strip 7 is placed on top portions of the wires 90. The first and second blocks 80, 82 are mated together. At the same time, the adhesive strips 7 are heated to integrally melt with and bind insulative sheaths of the wires 90. The wires 90 are thereby fixedly spaced along a horizontal plane. This wire assembly can be conveniently and efficiently stripped and soldered to terminals of a connector. The wires 90 can be stripped in a simple one-step operation, and then soldered to the terminals of the connector in a simple one-step operation.

However, the above integrating method still has some shortcomings. Each slot 800 in the first block 80 has a depth generally equal to only half a diameter of each wire 90. The wires 90 cannot be securely received in the first block 80, and are liable to fall from the first block 80 before mating of the first and second blocks 80, 82. Furthermore, two adhesive strips 7 are required. This unduly adds to costs. Finally, after repeated use, the first and second block 80, 82 are prone to misalign with each other. When this happens, melting of the adhesive strips 7 does not produce a configuration correctly enclosing free end portions of the wires therein and correctly spacing the wires from each other.

SUMMARY OF THE INVENTION

Accordingly, an object of the present invention is to provide a method for properly integrating a plurality of wires of a round cable in a reliable, safe, cost-efficient and convenient manner.

Another object of the present invention is to provide a method for integrating a round cable assembly whereby after repeated use of the method the method continues to be reliable, safe, cost-efficient and convenient.

A further object of the present invention is to provide a jig for conveniently and economically integrating end portions of wires of a round cable into a predetermined configuration corresponding to terminals of a cable connector to be connected with the round cable.

To fulfill the above objects, a jig in accordance with the present invention comprises an upper block and a lower block. The lower block has a jig plane in which a plurality of receiving grooves is defined. Each receiving groove has a width slightly larger than each diameter of a wire of a round cable to be integrated by the jig, and a depth greater than a radius of each wire but less than the diameter of each wire. The upper block has a pressing plane cooperating to the jig plane of the lower block. The wires of the round cable are placed into the receiving grooves of the lower block. An adhesive strip is placed onto insulative sheaths of the wires. The upper block is moved downwardly, driving the pressing plane to depress the adhesive strip. At the same time, the adhesive strip is heated so that it partly melts and integrally joins with the insulative sheaths of the wires.

DESCRIPTION OF THE PREFERRED EMBODIMENT

Figure 1:
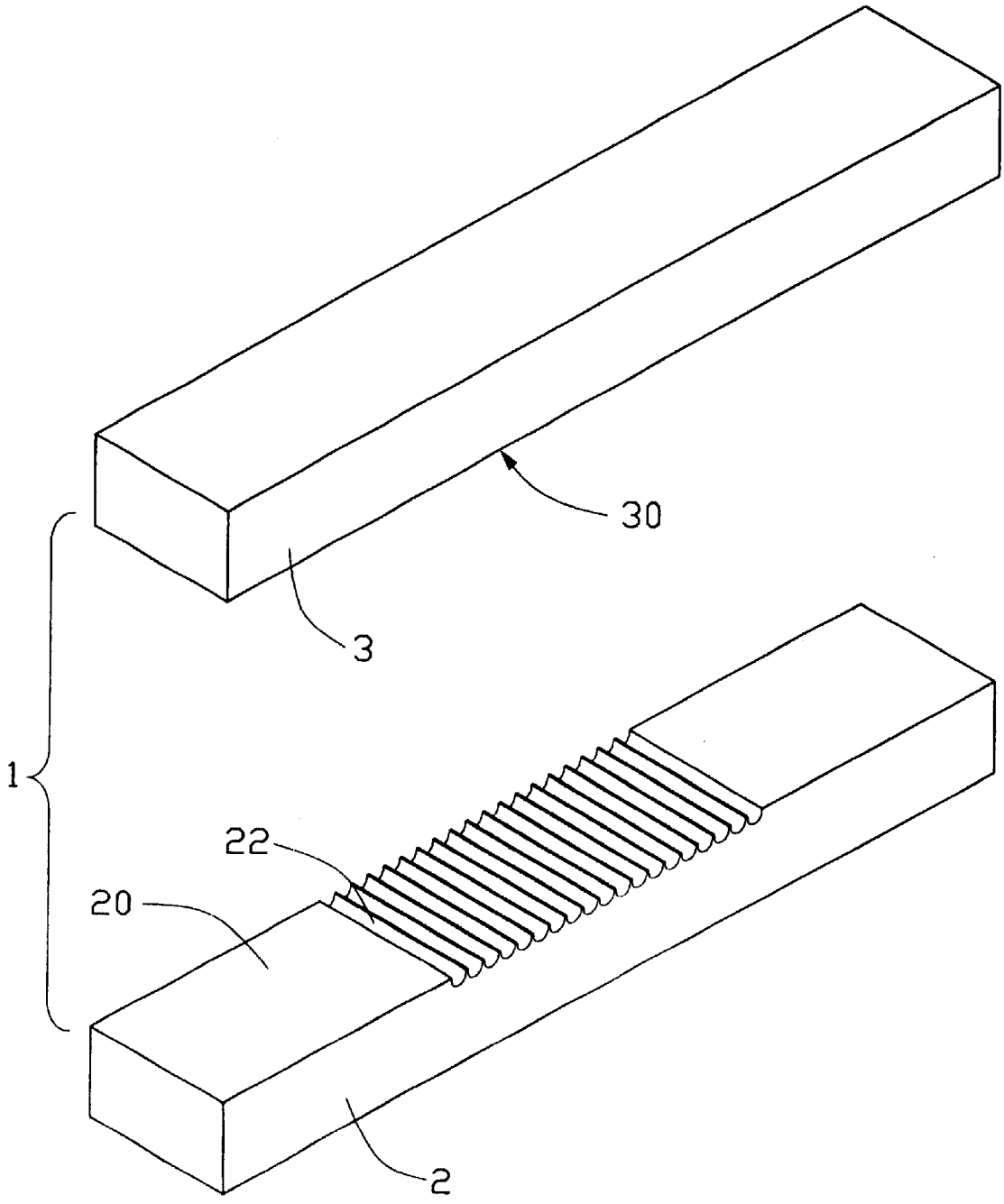
FIG. 1 is an exploded perspective view of a jig in accordance with the present invention for integrating end portions of wires of a round cable.

Referring to FIG. 1, a jig 1 in accordance with the present invention includes a lower block 2 and a upper block 3. The upper and lower blocks 3, 2, each have an elongated rectangular configuration. The lower block 2 has a jig plane 20 on a top face thereof, in which a plurality of parallel contiguous receiving grooves 22 is defined. The upper block 3 has a pressing plane 30 on a bottom face thereof. The upper block 3 also has a heating element (not labeled).

Figure 2:
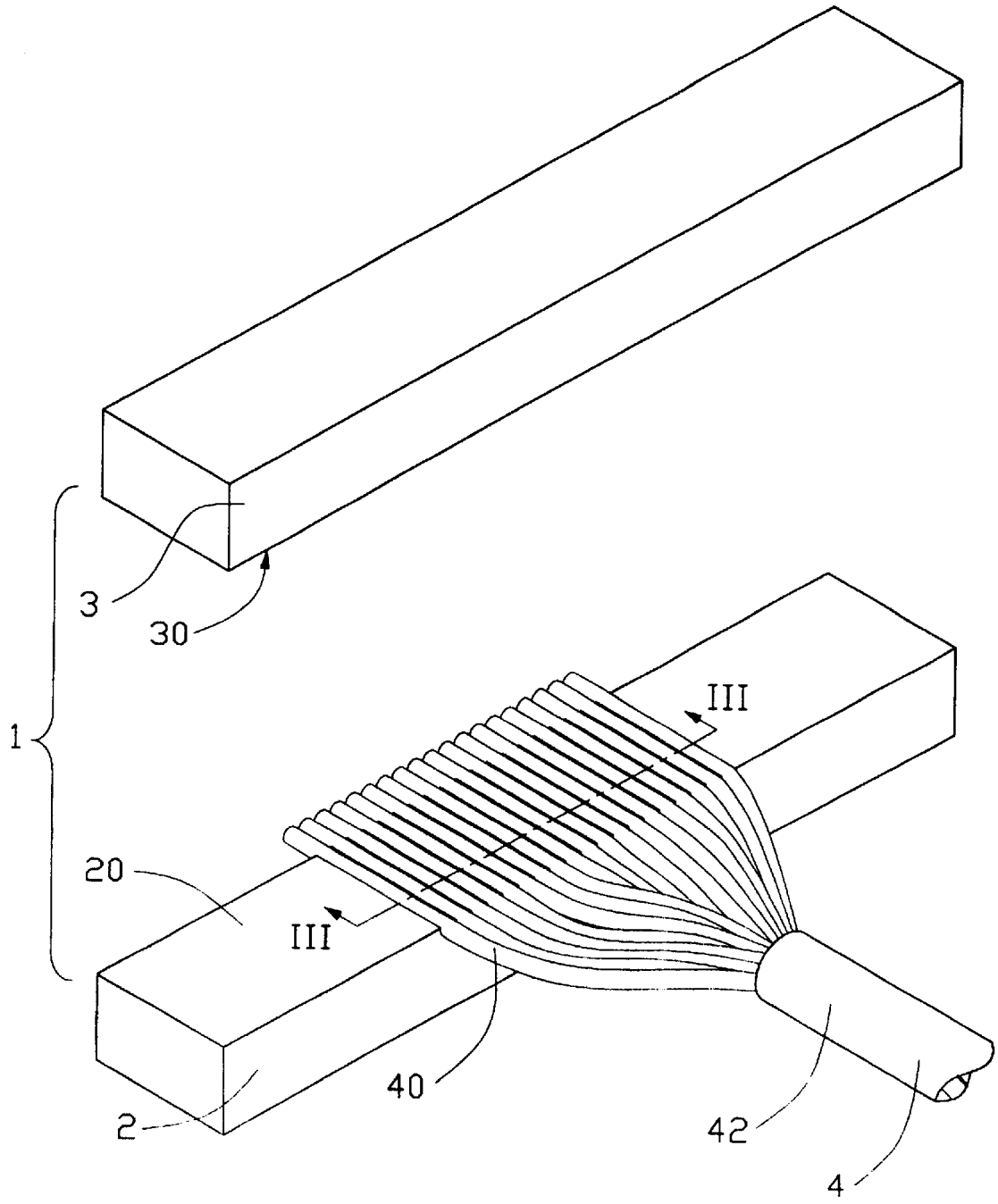
FIG. 2 is similar to FIG. 1, but showing the end portions of wires of a round cable received in grooves defined in a lower block of the jig.
Figure 3:
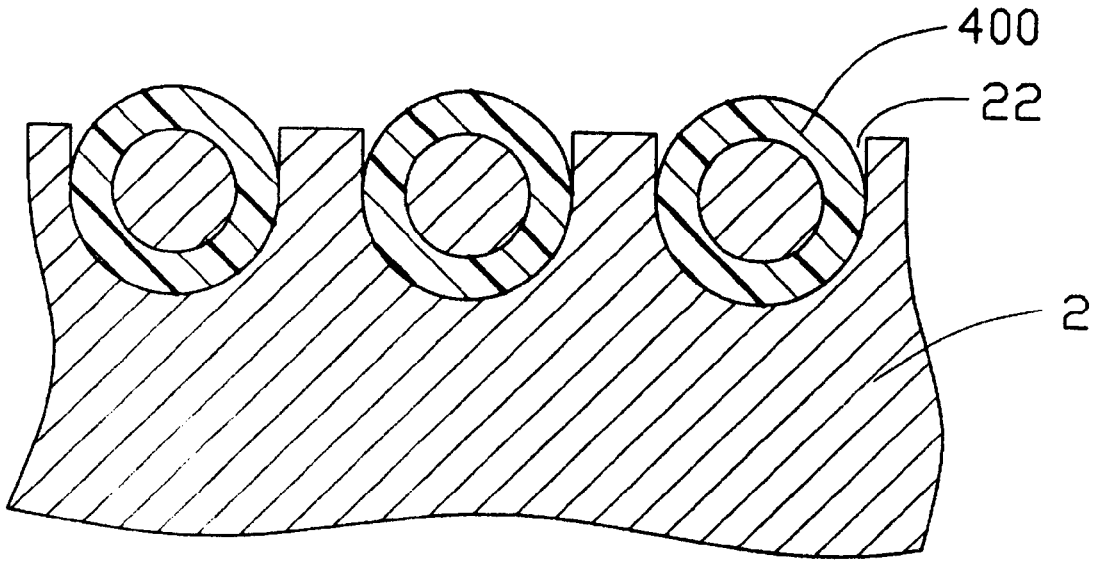
FIG. 3 is a cross-sectional view of part of the lower block and wires of FIG. 2, taken along line III—III of FIG. 2.

Referring to FIGS. 2 and 3, each receiving groove 22 of the lower block 2 has a U-shaped profile. Each receiving groove 22 has a width which is slightly larger than a diameter of each wire 40 of a round cable 4 to be arranged in the jig 1, and a depth greater than a radius of each wire 40 but less than the diameter of each wire 40. Each wire 40 has an insulative sheath 400.

Figure 4:
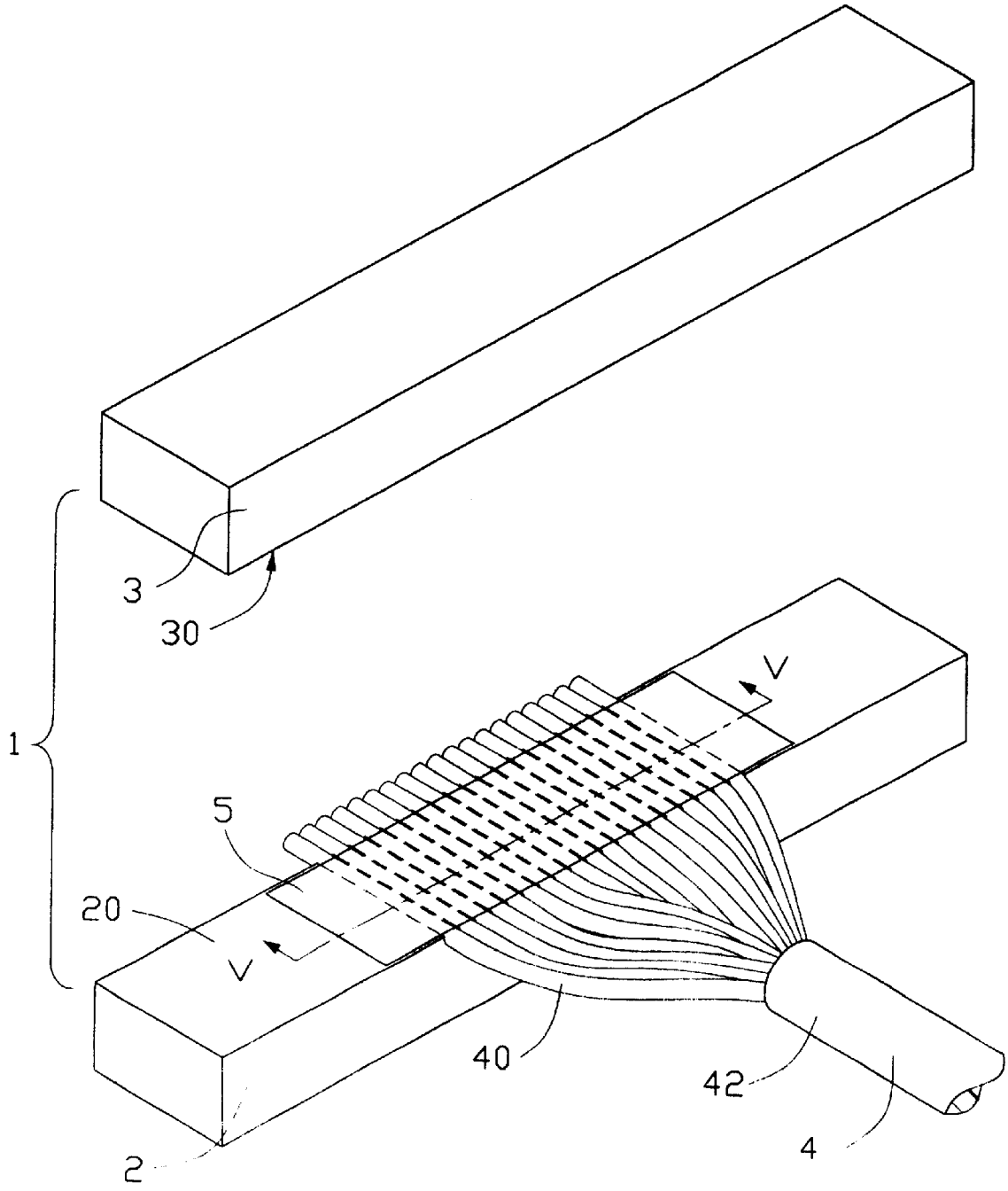
FIG. 4 is similar to FIG. 2, but showing an adhesive strip placed on end portions of the wires of the round cable.
Figure 5:
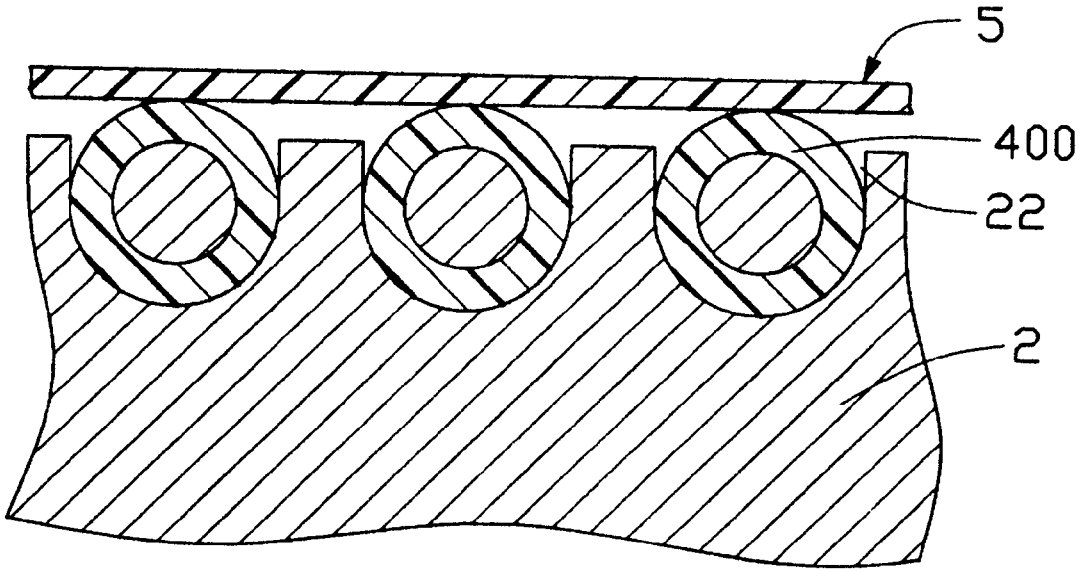
FIG. 5 is a cross-sectional view of part of the lower block, wires and adhesive strip of FIG. 4, taken along line V—V of FIG. 4.
Figure 6:
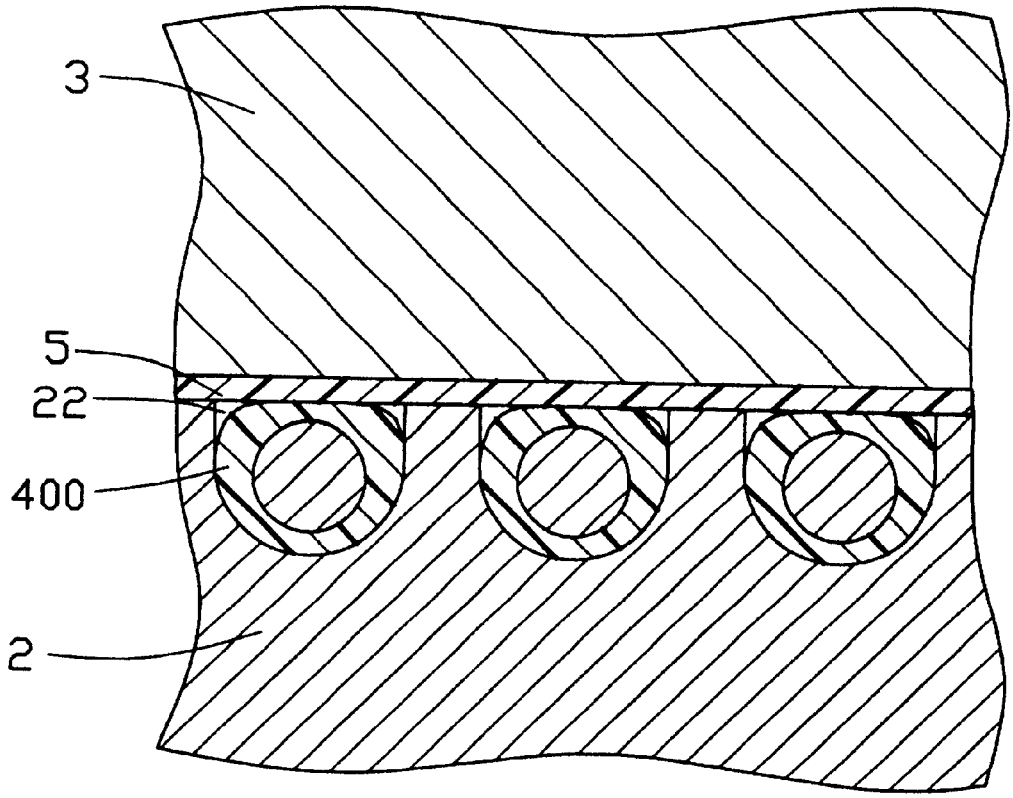
FIG. 6 is similar to FIG. 5, but showing an upper block of the jig depressing the adhesive strip against the wires.

Referring to FIGS. 4, 5, and 6, an adhesive strip 5 is used to bind the wires 40 together. In the preferred embodiment, the adhesive strip 5 is made of PVC.

Figure 7:
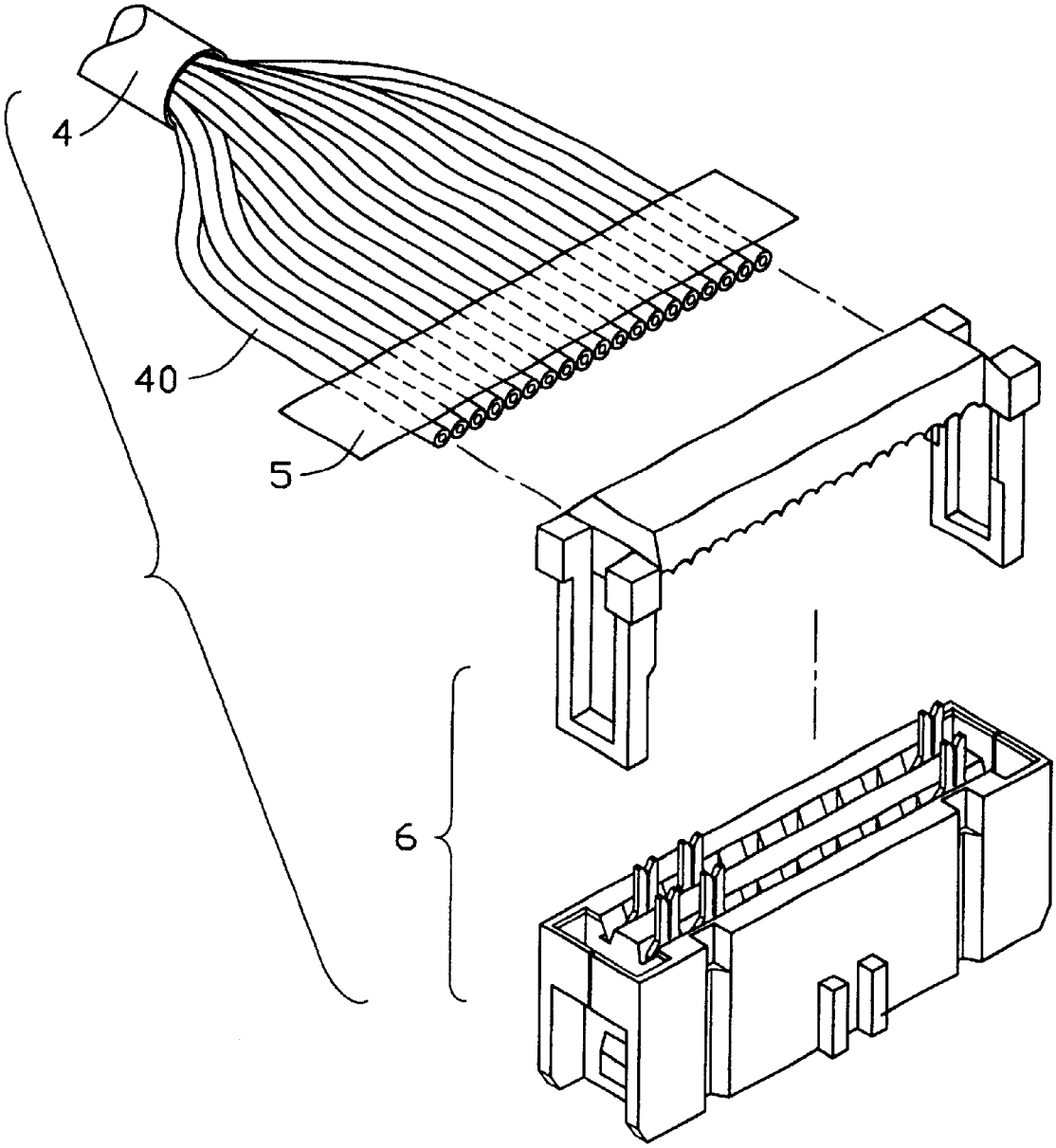
FIG. 7 is an exploded perspective view of a cable assembly in accordance with the present invention, and an electrical connector to be connected with the cable assembly.
Figure 8:
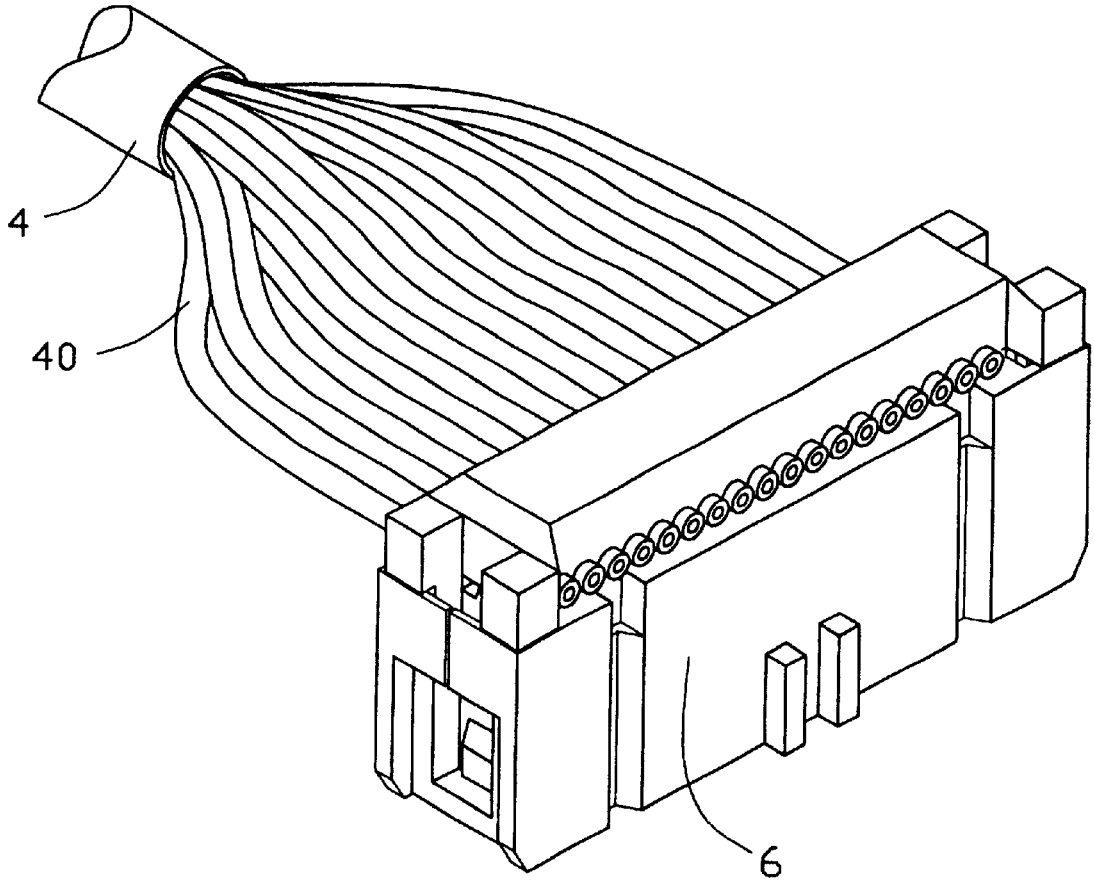
FIG. 8 is a finally assembled view of FIG. 7.
Figure 9:
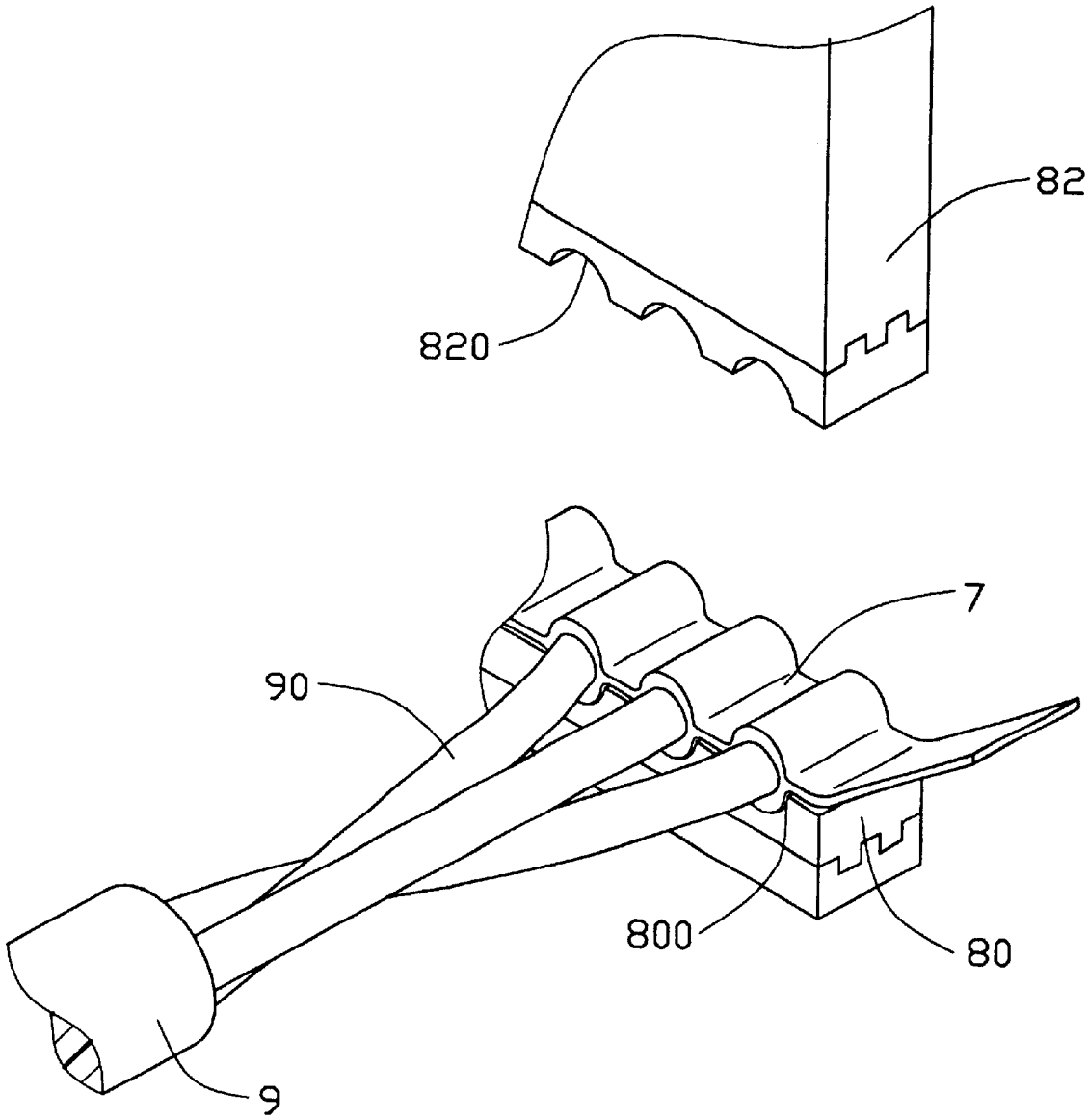
FIG. 9 (PRIOR ART)
FIG. 9 is a perspective view of a conventional jig together with a round cable, wires of the round cable, and adhesive strips.

Referring to FIGS. 7 and 8, the assembly of wires 40 is for connection to a corresponding electrical connector 6.

Referring to FIG. 6, the upper block 3 is moved downwardly. The pressing plane 30 of the upper block 3 depresses the adhesive strip 5, and the adhesive strip 5 depresses the insulative sheaths 400 of the wires 40 completely into the receiving grooves 22. Thus, the adhesive strip 5 is in pressing contact with the insulative sheaths 400. Simultaneously, the adhesive strip 5 is heated to a predetermined temperature by the heating element (not labeled) of the upper block 3, such that the adhesive strip 5 partly mets and integrally joins with the insulative sheaths 400. The upper block 3 is then removed from the assembly of wires 40, and the assembly of wires 40 is allowed to cool.

Referring again to FIGS. 7 and 8, since the assembly of wires 40 of the round cable 4 is now fixedly, integrally and accurately bound by the adhesive strip 5, the assembly of wires 40 is easily and rapidly mated between corresponding terminals (not labeled) of the connector 6.

Referring again to FIGS. 1, 2 and 3, in use, the wires 40 of the round cable 4 are placed into the receiving grooves 22 of the lower block 2 in a predetermined order. Due to the dimensions of the receiving grooves 22, only relatively small portions of the wires 40 are exposed above the jig plane 20 of the first block 2. In the preferred embodiment only portions of the insulative sheaths 400 protrude above the jig plane 20, whereas conductive cores (not labeled) of the wires 40 are disposed entirely below the jig plane 20. Thus, the wires 40 are accurately and securely held in the receiving grooves 22.

Referring to FIGS. 4, and 5, the adhesive strip 5 is then placed onto exposed portions of the wires 40. A bottom face of the strip 5 contacts the insulative sheaths 400 of the wires 40.

Alternative embodiments of the present invention include having the adhesive strip 5 made of materials other than PVC. Furthermore, the adhesive strip 5 can also be attached to the wires 40 of the round cable 4 by other means. Glue can be used to securely connect the adhesive strip 5 with the wires 40, which obviates the need for heating the adhesive strip 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A round cable assembly comprising:

a round cable;

a plurality of round wires extending out of a round cable outer jacket of said round cable, each of said round wires including an inner conductor and an outer sheath;

front portions of said round wires arranged side by side with one another;

a front end of the outer sheath of each of said round wires being deformed with a flat top portion; and a binding strip attached to said flat top portion of each of said round wires and integrating said round wires.

wherein said binding strip and corresponding front ends of said round wires are adapted to be sandwiched between a cover and a housing of a connector, such that fork type contacts of said connector pierce into the outer sheaths opposite to the flat top portions of the outer sheaths, respectively.

* * * * *